US011777250B2

(12) United States Patent
Goss et al.

(10) Patent No.: US 11,777,250 B2
(45) Date of Patent: Oct. 3, 2023

(54) ELECTRO-MECHANICAL CONNECTION APPARATUS

(71) Applicant: AURA Technologies, LLC, Chapel Hill, NC (US)

(72) Inventors: Garrett Goss, Morrisville, NC (US); Alex Blate, Chapel Hill, NC (US); Tom Place, Scottsdale, AZ (US)

(73) Assignee: AURA Technologies, LLC, Carrboro, NC (US)

( * ) Notice: Subject to any disclaimer, the term of this patent is extended or adjusted under 35 U.S.C. 154(b) by 0 days.

(21) Appl. No.: 18/098,894

(22) Filed: Jan. 19, 2023

(65) Prior Publication Data

US 2023/0155319 A1 May 18, 2023

Related U.S. Application Data

(63) Continuation of application No. PCT/US2021/044314, filed on Aug. 3, 2021.
(Continued)

(51) Int. Cl.
*H01R 13/73* (2006.01)
*H01R 13/52* (2006.01)
(Continued)

(52) U.S. Cl.
CPC ..... *H01R 13/5213* (2013.01); *H01R 13/26* (2013.01); *H01R 13/5219* (2013.01);
(Continued)

(58) Field of Classification Search
CPC ..... H01R 13/5213; H01R 13/26; H01R 13/5219; H01R 13/73; H01R 33/965; H01R 33/97
See application file for complete search history.

(56) References Cited

U.S. PATENT DOCUMENTS 4,795,359 A 1/1989 Alcock
6,952,343 B2 * 10/2005 Sato ..... G06F 1/1632 361/679.57
(Continued)

FOREIGN PATENT DOCUMENTS

WO 2019002846 A1 1/2019

OTHER PUBLICATIONS

International Search Report for PCT/US2021/044314, dated Nov. 30, 2021, 2 pages.
(Continued)

*Primary Examiner* — Tho D Ta
(74) *Attorney, Agent, or Firm* — Danielson Legal LLC

(57) ABSTRACT

An electro-mechanical connection apparatus. The apparatus includes a connection base configured to mechanically support an external device, and a first connection device operably connected to the connection base, wherein the first connection device is configured to operably connect with a second connection device associated with the external device. The first connection device includes a first electrical contact configured to establish an electrical connection with a second electrical contact of the external device, wherein the first electrical contact establishes the electrical connection with the second electrical contact while the connection base mechanically supports the external device.

17 Claims, 6 Drawing Sheets

Related U.S. Application Data

(60) Provisional application No. 63/060,617, filed on Aug. 3, 2020.

(51) Int. Cl.
*H01R 13/26* (2006.01)
*H01R 33/965* (2006.01)
*H01R 33/97* (2006.01)

(52) U.S. Cl.
CPC ..... *H01R 13/73* (2013.01); *H01R 33/965* (2013.01); *H01R 33/97* (2013.01)

(56) References Cited

U.S. PATENT DOCUMENTS

| | | | | |
|---|---|---|---|---|
| 7,573,159 | B1 | 8/2009 | Deiuliis | |
| 8,794,996 | B1 | 8/2014 | Matsuoka | |
| 9,179,567 | B2 * | 11/2015 | Hung | G06F 1/166 |
| 9,300,344 | B2 | 3/2016 | Rayner | |
| 9,331,422 | B2 | 5/2016 | Nazzaro | |
| 9,469,469 | B2 | 10/2016 | Rayner | |
| 9,997,876 | B2 | 6/2018 | Kasar | |
| 2004/0174671 | A1 * | 9/2004 | Huang | G06F 1/1632 361/679.55 |
| 2011/0306225 | A1 | 12/2011 | Chaize | |
| 2012/0206875 | A1 * | 8/2012 | Carnevali | G06F 1/1632 361/679.41 |
| 2013/0087666 | A1 * | 4/2013 | Chien | F16M 11/2014 248/122.1 |
| 2014/0030904 | A1 | 1/2014 | Head | |
| 2016/0072209 | A1 * | 3/2016 | Triplett | H01R 12/7076 439/587 |
| 2016/0211889 | A1 | 7/2016 | Bosscher et al. | |

OTHER PUBLICATIONS

Written Opinion for PCT/US2021/044314, dated Nov. 30, 2021, 5 pages.
International Search Report for PCT/US2021/044305, dated Dec. 8, 2021, 2 pages.
Written Opinion for PCT/US2021/044305, dated Dec. 8, 2021, 5 pages.

* cited by examiner

ELECTRO-MECHANICAL CONNECTION APPARATUS

CROSS REFERENCE TO RELATED APPLICATIONS

The present application is a continuation of International (PCT) Patent Application No. PCT/US2021/044314, filed internationally on Aug. 3, 2021, and claims the benefit of and priority to U.S. provisional application No. 63/060,617, filed on Aug. 3, 2020, the entire disclosure of each of which is hereby incorporated by reference as if set forth in itstheir entirety herein.

TECHNICAL FIELD

Embodiments described herein relate to electrical devices and, more particularly but not exclusively, to connectors of electrical devices.

BACKGROUND

End-user devices (for simplicity, "EUDs"), such as smartphones, tablets, and other electronic devices typically have one or more connectors for charging, data transfer, communication, or the like. For example, many EUDs expose USB connectors.

EUD connectors are typically light-duty and not robust to harsh environments. For example, these connectors are exposed to and susceptible to damage by environmental elements such as dust, sand, moisture, vibrations, or high g-loading environments. These harsh elements or conditions can be problematic for a connector or its electrical contacts, and can cause failures, malfunctions, loss of connection, or unavailability of the EUD or other devices or systems.

A need therefore exists for methods and devices for protecting EUD connectors from these environmental elements or conditions.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

According to one aspect, embodiments relate to an electro-mechanical connection apparatus. The apparatus includes a connection base configured to mechanically support an external device; and a first connection device operably connected to the connection base, wherein the first connection device is configured to operably connect with a second connection device associated with the external device and includes a first electrical contact configured to establish an electrical connection with a second electrical contact of the external device, wherein the first electrical contact establishes the electrical connection with the second electrical contact while the connection base mechanically supports the external device.

In some embodiments, the first connection device is a plug component and the first electrical contact is located on a surface of the plug component.

In some embodiments, the first connection device further includes a retention mechanism to removably secure the second connection device to the first connection device. In some embodiments, wherein the retention mechanism is specifically configured to release the second connection device from the first connection device upon being subjected to a sufficient force. In some embodiments, the retention mechanism is configured to receive and retain the second connection device in a specific orientation In some embodiments, the first connection device includes a plurality of threads, apertures, or studs to enable the first connection device to be removably secured to the connection base.

In some embodiments, the first connection device further includes an annual seal or radial seal to prevent a contaminant from contacting the first electrical contact.

In some embodiments, the first connection device is a socket component and the first electrical contact is located on a surface of the socket component. In some embodiments, the first connection device further includes at least one electrical connection point for attachment to a power source.

In some embodiments, the apparatus further includes a mounting portion to enable the connection apparatus to be worn by a user.

In some embodiments, the first electrical contact is located within a recess of the first connection device.

According to another aspect, embodiments relate to a connection device. The connection device includes a body portion configured to be mechanically supported by the connection base discussed above, and a second connection device configured to operably connect with the first connection device discussed above. The second connection device includes a second electrical contact to establish an electrical connection with the first electrical contact discussed above.

In some embodiments, the second connection device is a plug component and the second electrical contact is located on a surface of the plug component.

In some embodiments, the electronic device further includes an annual seal or radial seal to prevent a contaminant from contacting the second electrical contact.

In some embodiments, the second connection device is a socket component and the second electrical contact is located on a surface of the socket component.

In some embodiments, the second connection device is configured to be removably secured to the first connection device by a retention mechanism. In some embodiments, the retention mechanism is configured with the second connection device. In some embodiments, the retention mechanism is specifically configured to release the electronic device from the connection base discussed above upon being subjected to a sufficient force.

BRIEF DESCRIPTION OF DRAWINGS

Non-limiting and non-exhaustive embodiments of this disclosure are described with reference to the following figures, wherein like reference numerals refer to like parts throughout the various views unless otherwise specified.

DETAILED DESCRIPTION

Figure 1:
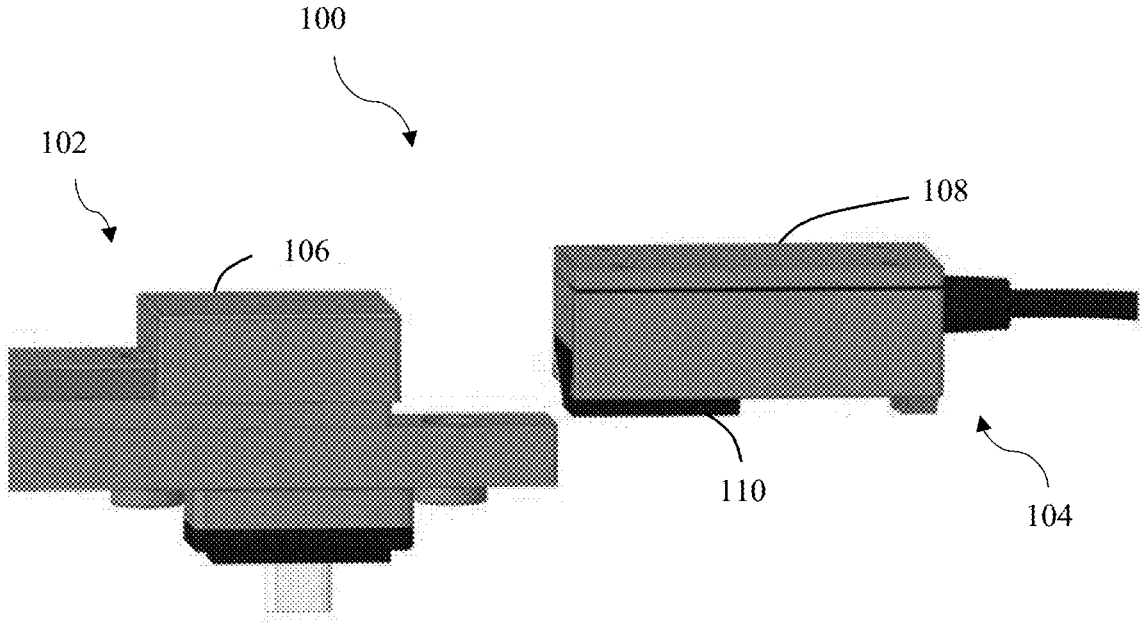
FIG. 1 illustrates a connection system in accordance with one embodiment.

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art. Embodiments may be practiced as methods, systems or devices. Accordingly, embodiments may take the form of a hardware implementation, an entirely software implementation or an implementation combining software and hardware aspects. The following detailed description is, therefore, not to be taken in a limiting sense.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment. The appearances of the phrase "in some embodiments" in various places in the specification are not necessarily all referring to the same embodiments.

Some portions of the description that follow are presented in terms of symbolic representations of operations on non-transient signals stored within a computer memory. These descriptions and representations are used by those skilled in the data processing arts to most effectively convey the substance of their work to others skilled in the art. Such operations typically require physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices. Portions of the present disclosure include processes and instructions that may be embodied in software, firmware or hardware, and when embodied in software, may be downloaded to reside on and be operated from different platforms used by a variety of operating systems.

The present disclosure also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each may be coupled to a computer system bus. Furthermore, the computers referred to in the specification may include a single processor or may be architectures employing multiple processor designs for increased computing capability.

The processes and displays presented herein are not inherently related to any particular computer or other apparatus. Various general-purpose systems may also be used with programs in accordance with the teachings herein, or it may prove convenient to construct more specialized apparatus to perform one or more method steps. The structure for a variety of these systems is discussed in the description below. In addition, any particular programming language that is sufficient for achieving the techniques and implementations of the present disclosure may be used. A variety of programming languages may be used to implement the present disclosure as discussed herein.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

Acronyms Used

AC—Alternating current

COTS—Commercial off-the-shelf

DC—Direct current

EUD—End-user device

FMC—FPGA mezzanine card

USB—Universal Serial Bus

The embodiments described herein provide novel electrical connectors and related devices that achieve improved connector performance and reliability. The connectors of the described embodiments are at the very least less susceptible to damage from environmental elements, conditions, or contaminants (for simplicity, "contaminants").

In the context of the present application, "contaminants" may refer to any solid, liquid, or other matter that is foreign to the connector or is the byproduct of wear and tear from environmental exposure. Commonly-encountered contaminants include, inter alia, dirt, dust, sand, debris, water or other liquids such as oils, corrosion, corrosion by-products, oxides, chips, shavings, or the like.

Existing EUD connectors may experience any one of a variety of failure modes due to contaminants. In failure modes, the electrical contacts of a plug or socket connector may become bent, deformed, or otherwise damaged due to the presence of contaminants. This is particularly true during insertion of a plug into or removal of a plug from a socket, or due to physical damage that occurs when the connectors are not mated. In some failure modes, contaminants may cause electrical contacts to fail to connect electrically or to cause a short circuit.

Contaminants may also compromise the alignment of electrical contacts of plug and socket connectors, as well as the retention of the plug in the socket. These failure modes may cause intermittent electrical connectivity and at the very least annoy EUD users.

For some failure modes, a user may be able to effect repairs such as by cleaning the connectors or their associated electrical contacts. In other failure modes, however, the plug or socket may be permanently damaged and require replacement. However, an EUD connector may not be separable from the EUD and the entire EUD must be replaced. Similarly, damage to a host connector may require the replacement of host components.

In the context of the present application, the terms "plug" and "socket" may refer to the connector mating halves of a connection system. In like manner, "insert" and "remove" may refer to the actions of connecting and disconnecting the mating halves, respectively. An EUD's connector may also be referred to as a "device connector," and the mating connector as the "host connector." These terms, however, do not restrict the geometry, electromechanical gender, or form of the respective halves of the connection system, nor the functions or semantics of the EUD or the host device.

Examples of host devices include, inter alia, chargers, power supplies, peripherals, or other computer systems. Some connectors may be hermaphroditic (i.e., the mating halves are identical). It should also be understood that an EUD connector may be a plug, socket, or some combination thereof. The term "mated" shall denote a condition in which the two halves of a connection system are coupled mechanically and electrically. For example, a plug that is fully inserted into a socket is considered mated with the socket.

During periods of non-mating (i.e., when the plug and socket are not mated) contaminants may collect or accumulate in or on the plug or socket. Contaminants may accumulate on the electrical contacts, for example. This may result in failures during mating.

The devices and methods herein provide connectors that are self-protecting to prevent the ingress of contaminants when unmated. Additionally or alternatively, the connectors are self-cleaning to remove or displace contaminants therefrom during mating.

The embodiments described herein may include a plug connector, a socket connector, and one or more contaminant removal portions to remove contaminants from a connector or protect the connector from contaminants. The plug and the socket connectors may each include one or more electrical contacts and a mechanical support structure.

The plug and the socket connectors may be configured such that insertion of the plug into the socket results in electrical connection or continuity between the electrical contacts of the plug and the socket. The plug may be mechanically-retained in the socket after insertion. In some embodiments, the one or more contaminant removal portion's points of attachment are stationary with respect to the axial dimension of the plug or the socket. During insertion of the plug into the socket, or removal of the plug from the socket, the one or more contaminant removal portions may pass axially along one or more electrical contacts to displace or remove contaminants therefrom.

The contaminant removal portion(s) may be configured as one or more wipers. The wipes may be formed from a foam, rubber, felt, fabric, or other type of elastic or compliant material. The wipers may be installed on the socket or the plug, for example. In some embodiments, wipers may be installed on the socket and the plug. Additionally or alternatively, wipers may be separate or separable from the socket and/or plug. For example, wipers may be installed in the body or frame of the EUD or other type of device.

As the plug is being inserted into the socket, one or more wipers may come into contact with the electrical contacts. For example, if the wiper(s) are installed on the plug, the wipers may come into contact with the electrical contacts of the plug during insertion. If the wipers are installed on the socket, they may come into electrical contacts of the socket during insertion. Regardless of the exact configuration or location of the wipers, they may remove contaminants from the electrical contacts in a variety of ways.

In some embodiments, the wiper may mechanically-displace contaminants. For example, as the plug is being inserted into a socket, the wiper may slide across an electrical contact and "brush" contaminants off of the electrical contact(s).

In other embodiments, the wiper may be formed from or otherwise include an absorbent material to absorb contaminants such as water or oils. For example, as the plug is being inserted into a socket, the wiper may slide across an electrical contact and absorb any contaminants on the electrical contact to remove the contaminants.

In other embodiments, the wiper may include some substance or chemical to polish the electrical contact to remove surface corrosion therefrom. Similarly, the wiper may be loaded or doped with one or more of a lubricant, dielectric lubricant or dielectric grease, corrosion inhibitor, water repellent, surfactant, anti-seize, or contact cleaning solution or compound (for simplicity, "dopant"). In some embodiments, such dopant can be replenished or reapplied to a wiper. In some embodiments, a wiper is replaced when its dopant is exhausted.

The wiper may also mechanically block contaminants from entering an unmated plug or socket, as well as displace or remove contaminants from other surfaces or spaces in or on the plug or socket. The socket or plug may be designed such that displaced contaminants are able to egress the connector. This egress may occur during one or more of plug insertion, establishment of mechanical retention, release of mechanical retention, or plug removal. In some embodiments, contaminants egress through the rear of the plug or socket. In some embodiments, contaminants are drawn out of the front of the plug or socket during removal.

A connector device may further include one or more wiper mechanisms in operable connectivity with a wiper to activate the wiper. The wiper mechanism may be configured move or rotate the wiper with respect to the electrical contacts of the socket or the plug. The wiper mechanism may activate the wipers during insertion of the plug into the socket as well as during removal of the plug from the socket. This activation causes the one or more wipers to move with respect to the electrical contacts, thereby displacing or removing contaminants from one or more of electrical contacts.

In some embodiments, the wiper mechanism is integrated into or attached to the plug or socket connector. In some embodiments, wiper mechanisms are present in both the plug and socket. In some embodiments, the wiper mechanism may be separate from the plug and socket.

In some embodiments, a connector is installed in or integrated into an assembly such as a mount for an EUD. In such embodiments, the wiper mechanism may be integrated into the EUD mount as well.

In some embodiments, the wiper mechanism rotates a wiper with respect to an electrical contact. In some embodiments, the wiper mechanism moves a wiper radially with respect to an electrical contact. The wiper mechanism may alternatively move a wiper axially with respect to an electrical contact.

FIG. 1 illustrates a connection system 100 in accordance with one embodiment. The system 100 of FIG. 1 includes a first connector 102 and a second connector 104 that is configured to mechanically and electrically connect with the first connector 102.

The first connector 102 may be configured with a case of an EUD such that the EUD is electrically charged while the first and second connectors 102 and 104 are connected with each other. The first connector 102 may include a retractable slide cover 106 that retracts during mating with the second connector 104. That is, as the first connector 102 and the second connector 104 come into contact, a housing 108 of the second connector 104 contacts and pushes the retractable slide cover 106 to expose electrical contacts of the first connector 102 (not shown in FIG. 1). Similarly, the second connector 104 includes a wiper 110 that retracts due to contact with the first connector 102 and removes contaminants from the electrical contacts of the second connector 104 (not shown in FIG. 1).

Figure 2:
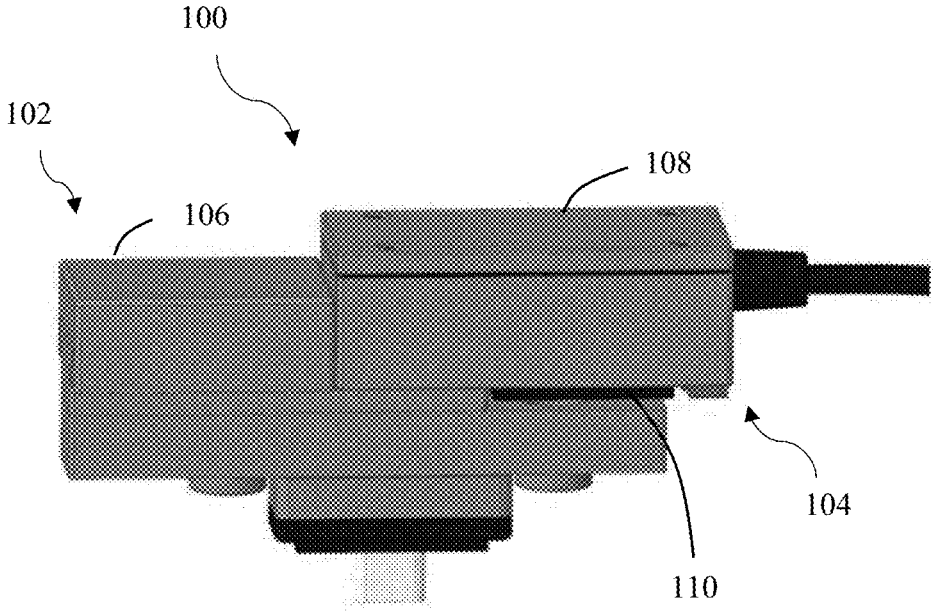
FIG. 2 illustrates the connection system of FIG. 1 in a mated or connected state in accordance with one embodiment.

FIG. 2 illustrates the connection system 100 of FIG. 1 in a mated or connected state. That is, the slide cover 106 of the first connector 102 and the wiper 110 of the second connector 104 have both been retracted to expose their respective electrical contacts (not shown in FIG. 2). This allows electrical connectivity to be established. The first connector 102 and the second connector 104 may be held in place by any sort of retention mechanism.

Figure 3:
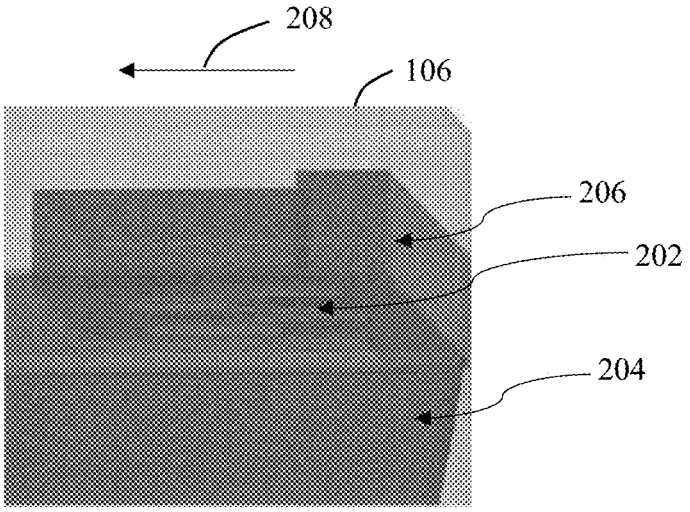
FIG. 3 illustrates a transparent view of a portion of the first connector of FIGS. 1 & 2 in accordance with one embodiment.

FIG. 3 illustrates a transparent view of a portion of the first connector 102 of FIGS. 1 & 2 in accordance with one embodiment. FIG. 3 shows the interior of the retractable slide cover 106, which includes a plurality of electrical contacts 202 on a base portion 204. The first connector 102 also includes a wiper 206. During mating with the second connector 104, the retractable slide cover 106 slides as indicted by arrow 208 to expose the electrical contacts 202. During this movement, the wiper 206 may remove contaminants from the electrical contacts 202 as discussed previously.

Figure 4:
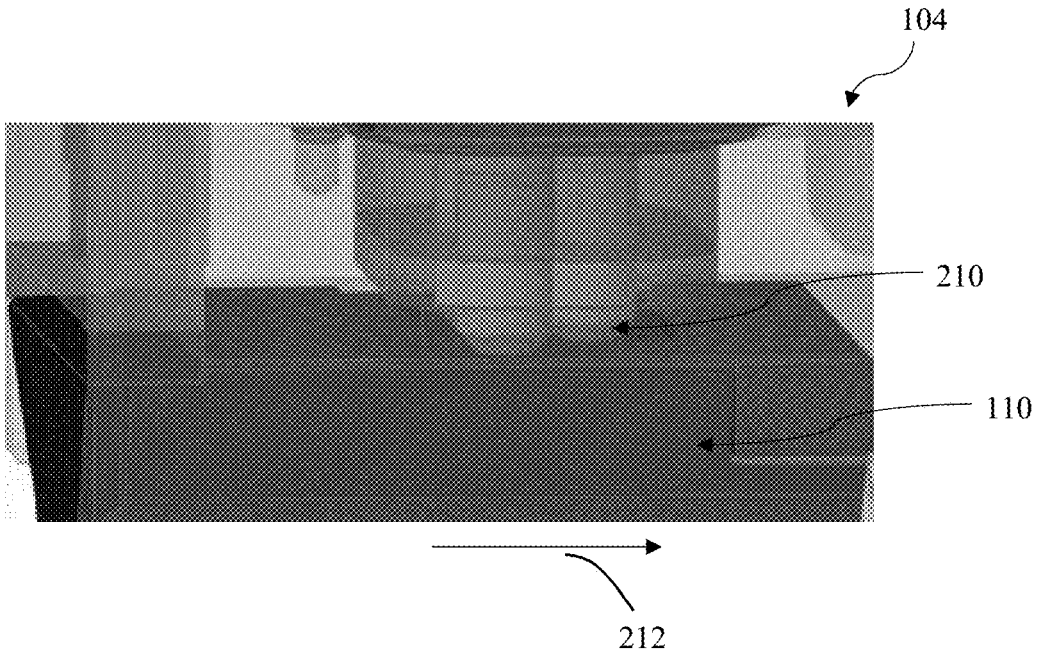
FIG. 4 illustrates a transparent view of a portion of the second connector of FIGS. 1 & 2 in accordance with one embodiment.

FIG. 4 illustrates a transparent view of a portion of the second connector 104 of FIGS. 1 & 2 in accordance with one embodiment. FIG. 4 shows the interior of the second connector 104, which includes electrical contacts 210 and the wiper 110. During mating with the first connector 102, the first connector 102 "pushes" the wiper 110 as indicated by the arrow 212 in FIG. 4, thereby removing contaminants from and exposing the electrical contacts 210.

The electrical contacts 202 and 210 may be annular conductors, axial strips, pad conductors, or the like. If the electrical contacts are annual conductors, they may also be configured as a structural component of the plug body. The electrical contacts may also be configured as a spring contact or an annular spring contact.

Figure 5A:
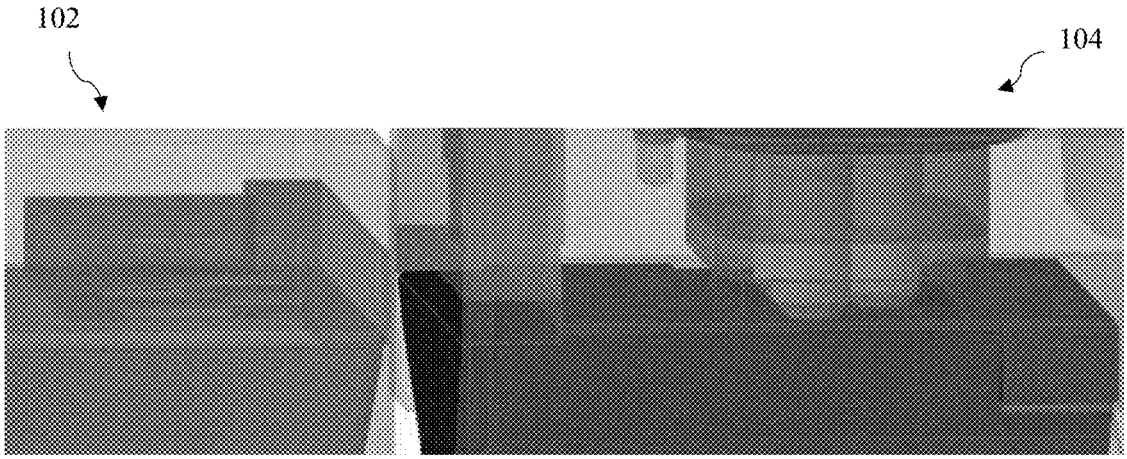
FIGS. 5A-D illustrate the mating process of the first and second connectors of FIGS. 1 & 2 in accordance with one embodiment.

FIGS. 5A-D illustrate the mating process of the first and second connectors 102 and 104 in accordance with one embodiment. As seen in FIG. 5A, the first connector 102 and the second connector 104 are lined up with each other to begin the mating process.

Figure 5B:
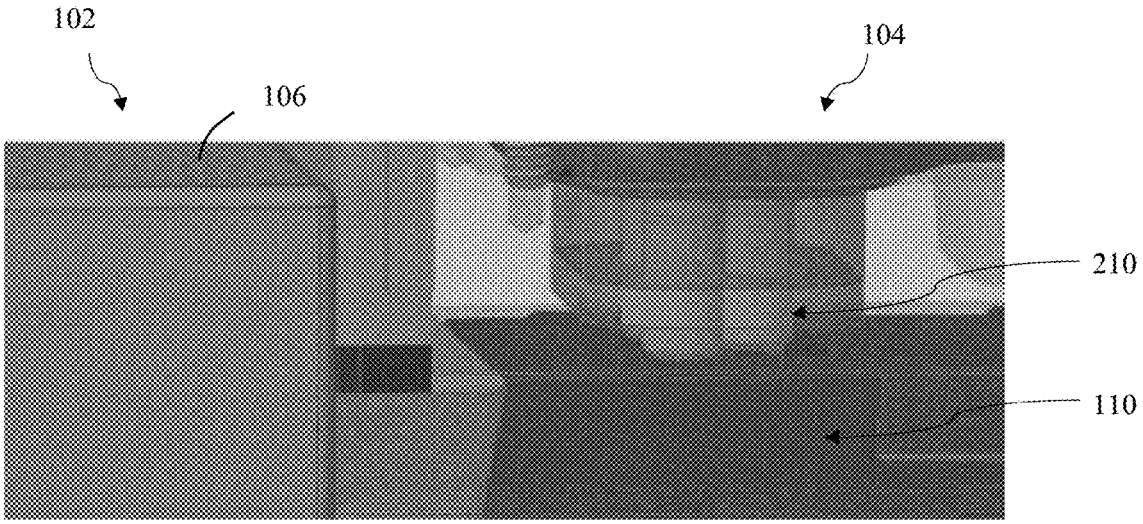

FIG. 5B shows the first connector 102 and the second connector 104 contacting each other. As this contact occurs, the retractable slide cover 106 retracts (to the left in FIG. 5B), and the first connector 102 pushes the wiper 110 of the second connector 104 (to the right in FIG. 5B). As the wiper 110 is pushed to the right, it slides across the electrical contacts 208 and removes contaminants therefrom as discussed previously.

The electrical contacts may be covered or plated with a corrosion-resistant conductive material, such as gold or a stainless-steel alloy. In some embodiments, the material of the contact surfaces is further resistant to electrolysis or electrolytic corrosion. The non-conductive areas of the plug or socket may include a hydrophobic material to reduce the adhesion of and encourage the shedding of aqueous contaminants.

Figure 5C:
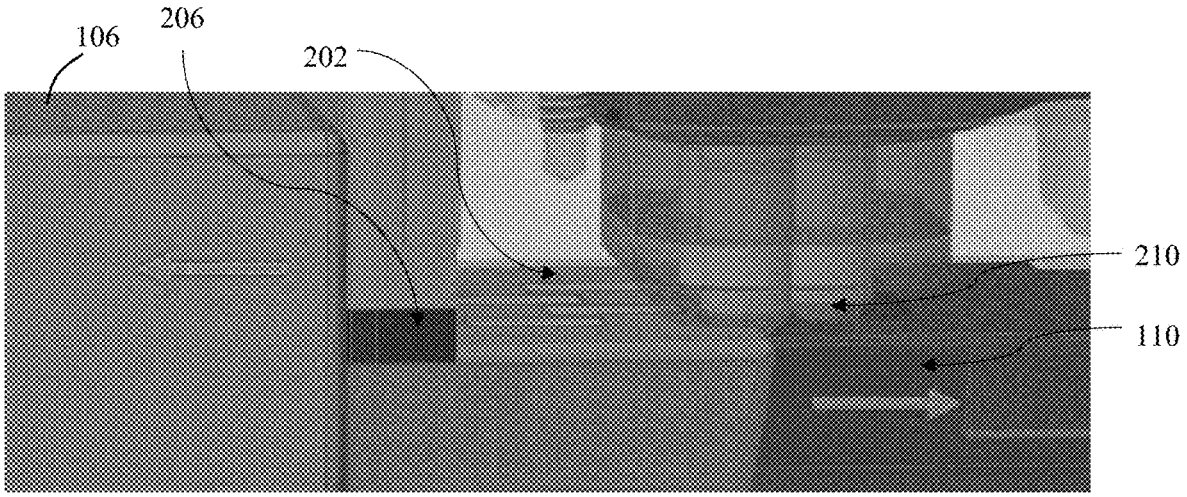

FIG. 5C illustrates a continuation of the mating process and shows the retractable slide cover 106 and the wiper 206 slide to the left. As the wiper 206 slides over the electrical contacts 202, it may remove contaminants therefrom as discussed previously. Similarly, the wiper 110 of the second connector 104 continues to remove contaminants from the electrical contacts 210 of the second connector 104.

Figure 5D:
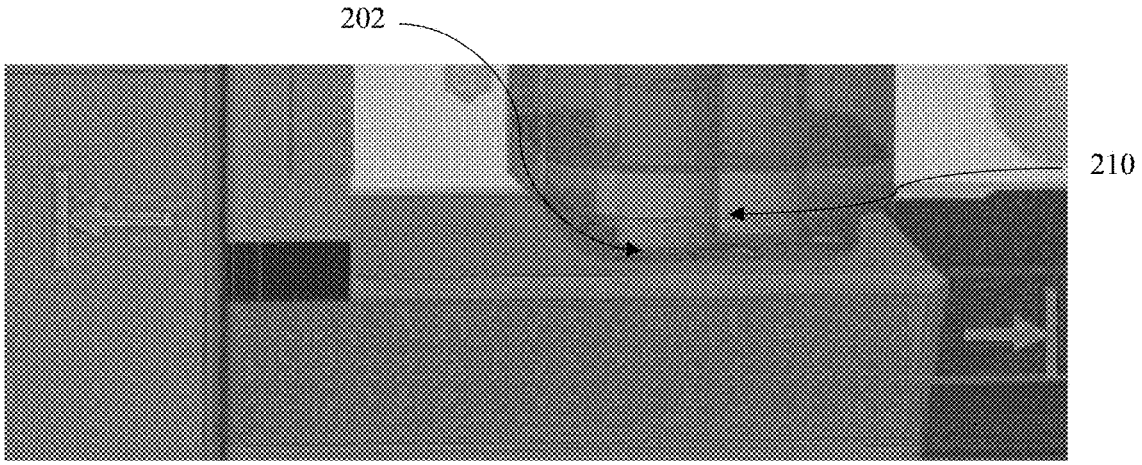

FIG. 5D illustrates the first connector 102 and the second connector 104 fully mated. As can be seen in FIG. 5D, the electrical contacts 202 and 210 are in contact with each other, thereby establishing an electrical connection between the first and second connectors 102 and 104. The second connector 104 can therefore provide power to the first connector 102 to, for example, charge the associated EUD.

Figure 6A:
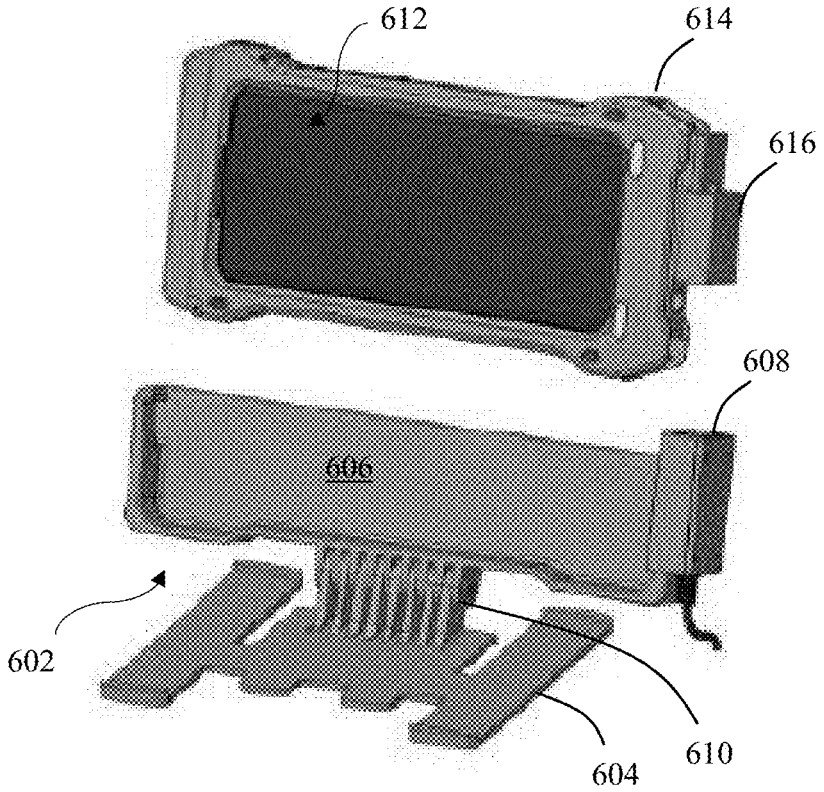
FIGS. 6A-C illustrate a connection support base receiving an EUD in accordance with one embodiment.

In some embodiments, the first connector 102 may be configured as part of an EUD frame, and the second connector 104 may be part of a connection support base. For example, FIG. 6A illustrates a base 602 that includes a mounting portion 604 and an EUD receptacle 606. The base 602 may also be configured with a base connector 608. The base connector 608 may be similar to the second connector 104 of FIGS. 1, 3, 4, and 5.

The mounting portion 604 may be configured to attach to a surface such as a wall, table, desk, or other type of surface such as to be worn by a user. The mounting portion 604 may be operably configured with one or more hinged portions 610 to connect with the EUD receptacle 606. This allows the EUD receptacle 606 to, for example, rotate or otherwise move to various orientations about the hinged portions 610.

The EUD receptacle 606 may be sized and configured to receive an EUD 612 such as a smartphone or tablet. For example, FIG. 6A shows the EUD 612, illustrated as a smartphone, enclosed in a case 614. The case 614 may provide protection for the smartphone, and may also include or otherwise be configured with an EUD connector 616. The EUD connector 616 may be similar to the first connector 102 of FIGS. 1, 2, 4, and 5.

Figure 6B:
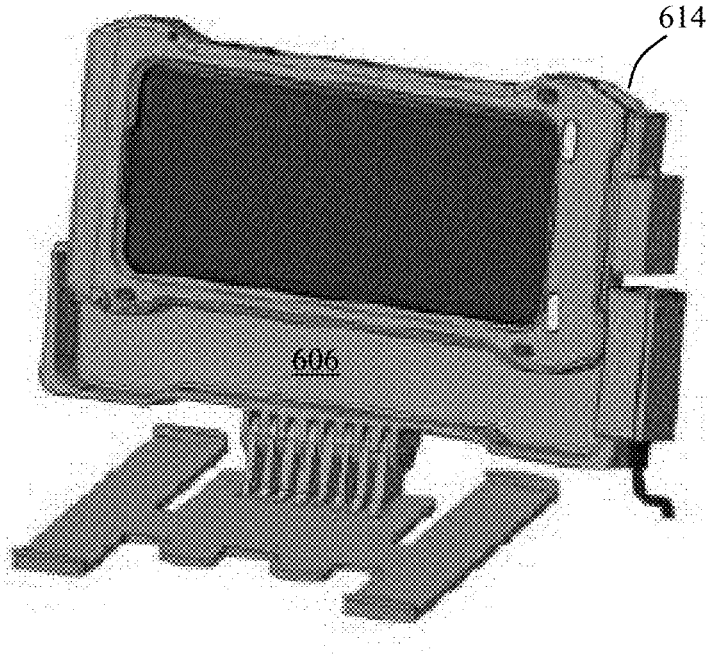

In operation, the case 614 may be slid into the case receptacle 606 such that the base 602 mechanically supports and secures the case 614, and therefore the EUD 612. For example, FIG. 6B illustrates the case 614 being slid into the case receptacle 606. The case 614 may include a series of grooves or slots that engage corresponding grooves or slots of the case receptacle 606.

Figure 6C:
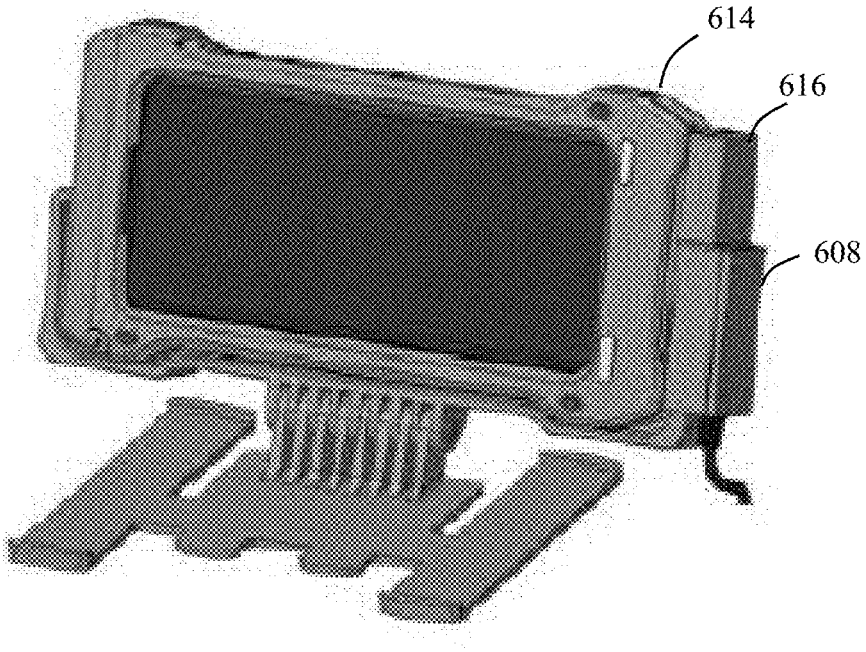

FIG. 6C illustrates these case 614 fully secured within the case receptacle 606. The case receptacle 606 may further include any appropriate retention mechanisms to further secure the case within the case receptacle 606. For example, the retention mechanism may include one or more magnets to secure the base connector.

FIG. 6C also shows that the EUD connector 616 is in operable connectivity with the base connector 608. That is, as the case 614 is slid into and secured within the case receptacle 606 the EUD connector 616 and the base connector 608 come into electrical connectivity with each other.

This connection process may be similar to the connection process shown in FIGS. 5A-D.

The structures of FIGS. 6A-C provide structural support and protection for EUDs, including during charging. The components can withstand, for example, specified radial or axial forces without permanent deformation or damage. The embodiments shown in FIGS. 6A-C are merely exemplary and other configurations or variations may be used without departing from the scope of the inventions herein.

In some embodiments, the base connector 608 or a component thereof may serve as an electrical connection point. For example, the base connector 608 may be designed for attachment to a wire or cable. An electrical connection point of the base connector 608 may be a through-hole pin or surface-mount pin. In some embodiments, an electrical connection point of the EUD connector 616 is contained or incorporated in a modular or flat-flex cable connector. In some embodiments, an electrical connection point of the EUD connector 616 is a solder cup, solder terminal, crimp terminal, or the like.

Although the EUD 612 in FIGS. 6A-C is illustrated in the case 614, the EUD 612 may be attached to other types of devices such as holsters, mounting brackets, or the like. In some embodiments, a case may not be necessary and the required connector components may be configured as part of the EUD 612. Similarly, the connector body or a components thereof may also be part of or physically into an external structure such as a case, holster, mounting bracket, or the like.

In some embodiments, a plug component further comprises internal or external threads (running axially) located on one or both ends of the plug. These threads may be used to attach the plug to an external structure. In some embodiments, the plug body further comprises one or more threaded holes or threaded studs located on one or both ends of the plug. These threaded holes or threaded studs, in conjunction with other fasteners, hardware, adhesives, or other bonding processes, may be used to attach the plug to an external structure.

In some embodiments, the socket body further comprises one or more threaded holes or threaded studs. These threaded holes or threaded studs, in conjunction with other fasteners, hardware, adhesives, or other bonding processes, may be used to attach the socket to an external structure.

In some embodiments, a socket connector may include a bore that is open at both ends (i.e., a through-hole), and a plug connector may be inserted into either end of the through-hole socket bore. In these cases, the plug connector is positively-retained and is electrically-connected, regardless of the direction of insertion. In some embodiments, a through-hole socket bore facilitates displacement and removal of contaminants from the socket during operation.

As discussed previously, the insertion of the plug into the socket may require one or more actuators to, for example, selectively release one or more retention mechanisms. In some embodiments, the plug can be inserted into the socket without interacting with an actuator. The actuator may have distinct engaged and disengaged positions or orientations, and may be locked or retained in one or both positions.

If more than one actuators are used to retain the plug component, some embodiments may require the simultaneous or sequential operation of two or more actuators. For example, the socket component may further comprise a safety lock that inhibits or blocks one or more actuators, or otherwise prevents inadvertent retention disengagement. Additionally or alternatively, the socket configuration may permit one-hand operation to achieve plug insertion, removal, engagement, and disengagement.

The configuration of the retention mechanism, as well as that of the plug and socket, may be such that the plug will safely release and be able to withdraw from the socket if a specified axial force or other type of force is applied to the plug. This may prevent damage to the plug, socket, or to other components.

While mated, a plug may be able to rotate about its axis through a specified angular range while maintaining mechanical retention and electrical connectivity. Electrical connectivity during such rotation may be facilitated or enhanced via multiple socket electrical contacts (e.g., multiple socket electrical contacts per electrical contact of the plug).

While mated, a plug can be retained at one or more specific angles of rotation about its axis to inhibit rotation of the plug. In some embodiments, operation of an actuator or other control mechanism enables the angle of the plug with respect to the socket to be adjusted or changed. In some embodiments, a plug may be free to rotate through some angular range(s) and be locked or retained at one or more angular orientations.

The design of the plug and socket may also permit insertion or retention of the plug in the socket at only one or more specific angular orientations. In some embodiments, the plug may include one or more axial grooves or slots to function as a key to prevent insertion at disallowed angles. This controlled angular positioning may ensure the specific orientation of one or more electrical contacts or to ensure correct electrical polarity.

The cross-section of a plug body may be an ellipsoid or other non-circular shape. This prevents rotation about the plug's central axis. In some embodiments, the broader arc of an ellipsoid enables better or more robust electrical contacts.

A portion of a plug may be hollow or relieved such that one or more parts or features of the socket can engage the plug interior when the plug is inserted in the socket or remains inserted in the socket. In some embodiments, one or more retention mechanisms engage with or interact with interior features of the plug. In some embodiments, one or more electrical contacts of the plug are located on its interior and one or more electrical contacts of the socket extend or protrude into the plug.

A socket or plug may also incorporate one or more radial or annular seals or gaskets. These seals or gaskets may function to, inter alia, prevent ingress of contaminants while the plug is retained within the socket.

In some embodiments, the electrical contacts of the socket may be retracted or otherwise prevented from connecting with the plug contacts until the plug is inserted to a specific depth or until one or more plug retainers are engaged. These contacts may be referred to as "safe contacts." In some embodiments, power or ground contacts may be safe contacts. In some embodiments, a safe contact further comprises a seal or gasket that protects the contact from contaminants when the connector is unmated or the contact is in the retracted position.

Although not shown in the above figures, the plug connector may further include electrostatic discharge protection devices, reverse-polarity protection devices, fusing devices, mechanical switches, sensors, or the like. In some embodiments, the exterior of the plug comprises annular conductors separated by insulators. The axial dimensions of the insulators, their material(s), and their surface finish or geometry are chosen such that, even in the presence of a film or an aqueous contaminant, the Ohmic resistance between adjacent conductors is high enough to prevent electrical faults or malfunctions. Similarly, the configuration of the insulators maintains the creepage or leakage current between adjacent conductors below a specified tolerance.

In some embodiments, the plug connector may include one or more recesses with an electrical contact located therein. A socket electrical contact may act as a plug retainer that engages with the plug recess. That is, the engagement of the socket electrical contact with the plug recess provides positive mechanical retention of the plug within the socket and also establishes electrical connectivity.

The plug recess may be configured as an axial groove, slot, partial or full annular groove, or the like. In other embodiments, the plug recess may be a hole having a circular, ellipsoidal, or polygonal cross-section. The plug recess may be designed such that the conductive contact surface is strictly below the major diameter of the plug body so that contact with the electrical contact surface requires protrusion into the recess.

Regardless of the exact configuration, the geometry of a plug recess is such that the engagement of a plug retainer contact (i.e., the socket electrical contact) with the plug recess results in an axial force on the plug. This axial force prevents or reduces movement in the mated connector.

In some embodiments, the plug retainer contact may be shaped as a hook and rotate about a pivot that is at least approximately parallel to the axis of a socket bore. The inner radius of the hook may engage with an annular recess in the plug. In some embodiments, the end or tip of the hook engages with a hole or other recess in the plug. In some embodiments, the inner radius and the end of the hook engage with an appropriately-shaped recess in the plug.

A plug retainer contact may constructed of a metal such as copper, brass, or a steel alloy. In some embodiments, a plug retainer contact is plated, at least on the surfaces responsible for electrical connectivity, with a corrosion-resistant metal such as gold.

In other embodiments, the plug retainer contact may be shaped as an arc having a minor radius that is similar to the minor diameter of a corresponding annular plug recess. In these embodiments, the arc may be oriented perpendicularly to the axis of the socket bore and may move radially with respect to the bore.

A plug retainer contact may alternatively be a ball or semi-spherical detent, pin detent, or equivalent that engages with a plug recess. In some embodiments, the motion of such a plug retainer contact is radial with respect to the socket bore.

A plug retainer contact may have a rectangular or oblong shape with its major or long dimension parallel to the axis of the socket bore. In these embodiments, the plug retainer contact may engage an axial slot or equivalent plug recess. In these embodiments, any motion of such a plug retainer contact is radial with respect to the socket bore.

The geometry or motion of a first plug retainer contact may be such that it imparts an axial force on the plug when engaged or in the retention position. For example, such axial force may prevent or reduce axial movement in the mated position and may ensure precise axial alignment of other electrical contacts.

In some embodiments, the geometry or motion of a second plug retainer contact is such that it imparts an axial force on the plug when engaged or in the retention position. The direction of the axial force imparted by the second plug retainer contact may be opposite or opposed to that of the first plug retainer contact.

In embodiments with a first and second plug retainer contact, the engagement of the first plug retainer contact with a corresponding plug recess may impart a rotational force on the plug in a first rotational direction about the plug's axis. The engagement of the second plug retainer contact with a corresponding plug recess imparts a rotational force on the plug in a second rotational direction about the plug's axis. In some embodiments, the first rotational direction and the second rotational direction may be different. This arrangement may prevent or reduce rotational movement of the plug when mated or may at least ensure precise rotational alignment of other electrical contacts. The location or geometry of the first plug retainer contact may be such that it cannot engage with the second plug retainer recess.

The use of axially- or rotationally-opposed plug retainer contacts may at least improve mechanical retention and electrical connections in the presence of contaminants. These plug retainer contacts may minimize or prevent deterioration of retention and electrical connection performance that would result from wear of the socket or plug or due to tolerance differences of the socket with respect to the plug. In some embodiments, the motion or friction of axially- or rotationally-opposed plug retainer contacts against the respective plug recesses may also displace contaminants, reduce or remove corrosion, or otherwise make the contacts "self-cleaning."

At least one plug retainer contact is able to be fully-retracted from the socket bore. In some embodiments, the engagement of at least one plug retainer contact is inhibited or prevented until and unless the plug is inserted to a specified depth and/or an actuator is activated.

Two or more plug recesses may be located in the same axial position, separated by some arc length(s). Two or more corresponding plug retainer contacts may be located in the same axial position, separated by a similar arc length or lengths. These radial plug recesses and radial plug retainer contacts may be used for impedance-controlled, differential electrical connections.

Some embodiments comprise electrical contacts that are not plug retainer contacts. For example, plug retainer contacts may be used for power and ground connections, while spring contacts may be used for data lines.

In some embodiments, as retention of the contacts occur, the first plug retainer contact makes electrical contact with the plug before the second plug retainer contact makes electrical contact with the plug. As retention is disengaged, the second plug retainer contact disconnects electrically from the plug before the first plug retainer contact disconnects electrically from the plug.

The embodiments described herein may also implement or otherwise include different types of connectors. For example, coaxial, spring-loaded contacts may be used in the connector systems herein and use spring tension to help ensure positive mechanical contact between a pin and its mating contact.

Pogo pins are one example of connectors that may be used in accordance with the embodiments described herein. A pogo pin typically comprises a fixed base, a movable tip, and a spring. The tip moves axially within the base due to outward pressure from the spring. This ensures compliance and reliable electrical connectivity.

Leaf-spring contacts are another type of contact, and typically comprise one or more pieces of bent sheet metal. Functionally, a leaf spring contact comprises a fixed base, a movable contact surface, and a spring. The movable contact surface is located on the end of a leaf spring instead of the contact and spring being physically separate parts.

Embodiments described herein may use these types of connectors to provide an improved spring contact connector. In some embodiments, the spring contact connector may include at least one spring contact comprising a base, a spring, and a movable contact that is biased away from the spring; at least one non-conductive gasket that is physically attached to and makes a seal around the movable contact; and at least one supporting structure. In operation, as the movable contact moves, the at least one gasket moves or flexes relative to the base. A portion of the movable contact may protrude or be exposed on the side of a gasket opposite from the base, and one or more spring contacts and gasket(s) may be attached to the supporting structure(s).

The gasket may attach to or couple with a movable contact in a variety of ways. For example, the gasket may attach to the movable contact via one or more grooves, slots, or annular rings. These grooves, slots, rings, or the like may be formed in, machined into, or installed on the movable contact. The gasket may be further secured to the movable contact by an adhesive, sealant, or the like. In some embodiments, the gasket can be separated from the contact and supporting structure for replacement, cleaning, or for other service-related activities.

A gasket may be coupled to one or more movable contacts by injection molding of the gasket material around an array or matrix of a plurality of spring contacts. In these embodiments, each spring contact may be mounted, installed, or attached to a supporting structure.

The base, movable contact, and (optionally) the spring are electrically-conductive and there is electrical continuity between the contact surface and base throughout a prescribed range of movement of the contact. In these embodiments, the contact-coupled gasket is fixed with respect to each contact and moves with respect to the base. In a base-coupled gasket configuration (discussed below), the gasket is fixed to the base and the contacts move with respect to the gasket.

The gasket may be made from a non-conductive foam, rubber, felt, fabric, elastomeric material, silicone, or other elastic compliant material such that the gasket does not impede the motion of the movable contact or damaged by its motion. The gasket may attach to or couple with a movable contact by means of grooves, slots, or annular rings that are formed in, machined into, or installed on the movable contact. In some embodiments, the gasket maintains its elasticity across most or all terrestrial temperatures (e.g., from −40° C. to 50° C.).

The gasket may be formed, fitted, or installed on an array or matrix of multiple spring contacts. These contacts may be mounted, installed, or attached to a supporting structure. In these configurations, the gasket may supply spring bias or tension to supplement the bias or tension of the spring(s).

Similarly, the composition and geometry of the gasket may provide mechanical support or protection against axial forces on the movable contact(s). The gasket also provides a water-tight or water-resistant seal between moving contact surfaces and the contact bases. A gasket may also comprise an RF-shielding or screening material to protect the connector from radio frequency emissions or electromagnetic interference.

The gasket may remove contaminants from the connector devices by at the very least shielding the connector from said contaminants. That is, a gasket further acts as a seal such as when the connector is mated. This seal prevents or slows the ingress of liquid or solid contaminants. In the context of the present application, the term "removal" or "contaminant removal" may refer to the act of protecting components from contaminants, as well as the functionality provided by the above-discussed wipers.

In some embodiments, a connector may comprise a stack of multiple gaskets. In these embodiments, the outer-most gasket (i.e., the gasket that is most-distant from the base of the spring contact) may be designed to protect the gasket from mechanical damage or damage from contaminants. This outer-most gasket layer may not be coupled mechanically to the movable contact(s), and may or may not be attached to the other gasket layers. The outer-gasket layer may or may not be compliant or flexible.

At rest, such as when the connector is unmated or the contact is not under compression, a portion of the movable contact may protrude on the side of a gasket that is opposite the base. When at rest, a movable contact may not protrude through a gasket, but may be able to protrude on the side of the gasket opposite the base as the gasket is compressed or during mating of the connector.

The supporting structure may comprise a printed circuit board (PCB). In some embodiments, a supporting structure may comprise a plastic, composite, or other non-conductive frame that holds and supports the spring contacts. The gasket may or may not be attached to or coupled to a supporting structure. In some embodiments, parts of the supporting structure may comprise metals.

The supporting structure may be designed with one or more holes, slots, reliefs, or other features such that any contaminants that bypass all gaskets, and become proximate to the contact base, are not trapped within the connector. This may facilitate, for example, the evaporation of liquid contaminants.

In some embodiments, the gasket is physically attached to, installed, or formed in the supporting structure. In these configurations, the gasket is stationary with respect to the base of the spring contact, as opposed to being physically attached to and making a seal around the movable contact.

In these embodiments, the gasket makes a seal around the base and at least some portion of the movable contact. The gasket remains stationary as the movable contact moves. Some portion of the movable contact protrudes or is exposed on the side of a gasket opposite from the base or becomes exposed as the gasket is compressed during mating. In these embodiments, the gasket may further comprise one or more holes or slits such that the gasket can fit over the spring contacts and permit motion of the movable contacts. With this design, the gasket is positively-attached to or pressed against the base of spring contacts.

The gasket may be attached to the spring contacts through, for example, injection molding, over-molding, or by pouring a liquid material that subsequently solidifies. In such cases, the composition of the gasket is such that it does not adhere to the movable contacts and thus permits motion over their range of travel. In some embodiments, the gasket is formed after the one or more spring contacts are attached to or installed on a supporting structure. Once installed, the gasket may make a water-tight or water-resistant seal over the base.

A purpose-designed tool or jig may be used to remove or install a gasket. The tool's function may involve aligning a gasket with one or more spring contacts, supporting the movable contact(s), separating a gasket from the supporting structure or contact bases, or pressing a gasket into its desired position.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Embodiments of the present disclosure, for example, are described above with reference to block diagrams and/or operational illustrations of methods, systems, and computer program products according to embodiments of the present disclosure. The functions/acts noted in the blocks may occur out of the order as shown in any flowchart. For example, two blocks shown in succession may in fact be executed substantially concurrent or the blocks may sometimes be executed in the reverse order, depending upon the functionality/acts involved. Additionally, or alternatively, not all of the blocks shown in any flowchart need to be performed and/or executed. For example, if a given flowchart has five blocks containing functions/acts, it may be the case that only three of the five blocks are performed and/or executed. In this example, any of the three of the five blocks may be performed and/or executed.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

What is claimed is:

1. An electro-mechanical connection apparatus comprising:

a base configured to mechanically support an external device, wherein the external device includes a device connector; and a base connector operably connected to the base, wherein the base connector is configured to operably connect with a device connector associated with the external device and includes:

a retention mechanism to removably secure the device connector to the base connector regardless of orientation of the apparatus and release the device connector from the base connector upon being subjected to a sufficient force, and a first electrical contact configured to establish an electrical connection with a second electrical contact of the external device, wherein the first electrical contact establishes the electrical connection with the second electrical contact while the base mechanically supports the external device.

2. The connection apparatus of claim 1 wherein the base connector is a plug component and the first electrical contact is located on a surface of the plug component.

3. The connection apparatus of claim 1 wherein the sufficient force is a force applied to a release mechanism of the retention mechanism to release the device connector from the base connector.

4. The connection apparatus of claim 1 wherein the sufficient force is a force applied to the apparatus that is sufficient to automatically release the device connector from the base connector.

5. The connection apparatus of claim 1 wherein the retention mechanism is configured to receive and retain the device connector in a specific orientation.

6. The connection apparatus of claim 1 wherein the base connector further includes an annual seal or radial seal to prevent a contaminant from contacting the first electrical contact.

7. The connection apparatus of claim 1 further comprising a mounting portion to enable the connection apparatus to be worn by a user.

8. The connection apparatus of claim 1 wherein the first electrical contact is located within a recess of the base connector.

9. The connection apparatus of claim 1 wherein the base connector is a socket component and the first electrical contact is located on a surface of the socket component.

10. The connection apparatus of claim 9 wherein the base connector further includes at least one electrical connection point for attachment to a power source.

11. An electronic device comprising:

a case configured to be mechanically supported by the base of claim 1; and a device connector configured to operably connect with the base connector of claim 1, wherein the device connector includes a second electrical contact to establish an electrical connection with the first electrical contact of claim 1.

12. The electronic device of claim 11, wherein the device connector is a plug component and the second electrical contact is located on a surface of the plug component.

13. The electronic device of claim 11 further comprising an annual seal or radial seal to prevent a contaminant from contacting the second electrical contact.

14. The electronic device of claim 11 wherein the device connector is a socket component and the second electrical contact is located on a surface of the socket component.

15. The electronic device of claim 11 wherein the device connector is configured to be removably secured to the base connector by a retention mechanism.

16. The electronic device of claim 15 wherein the retention mechanism is configured with the device connector.

17. The electronic device of claim 15 wherein the retention mechanism is specifically configured to release the electronic device from the base of claim 1 upon being subjected to a sufficient force.

* * * * *